US006688138B2

(12) United States Patent
DiFlora

(10) Patent No.: US 6,688,138 B2
(45) Date of Patent: Feb. 10, 2004

(54) HEAT EXCHANGER HAVING HEADER

(75) Inventor: Michael A. DiFlora, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/123,272

(22) Filed: Apr. 16, 2002

(65) Prior Publication Data

US 2003/0192340 A1 Oct. 16, 2003

(51) Int. Cl.[7] ..... F25B 39/02; F25B 39/04
(52) U.S. Cl. ..... 62/525; 62/509
(58) Field of Search ..... 62/525, 509, 515, 62/524; 165/154, 175, 155

(56) References Cited

U.S. PATENT DOCUMENTS

| | | | | |
|---|---|---|---|---|
| 1,809,075 A | | 6/1931 | Scovel, Jr. | |
| 1,863,718 A | | 6/1932 | Kleist | |
| 2,120,764 A | | 6/1938 | Newton | 62/3 |
| 2,423,697 A | | 7/1947 | Garfield | 29/157.3 |
| 3,139,927 A | * | 7/1964 | Binner et al. | 165/159 |
| 3,197,975 A | | 8/1965 | Boling | 62/498 |
| 3,453,840 A | | 7/1969 | Nagakura et al. | 62/324 |
| 3,545,063 A | | 12/1970 | Mitchell | 29/157.3 |
| 4,359,879 A | | 11/1982 | Wright | 62/513 |
| 4,497,365 A | | 2/1985 | Boyer | 165/164 |
| 4,852,368 A | | 8/1989 | Bravo | 62/515 |
| 4,936,113 A | | 6/1990 | Nivens | 62/513 |
| 5,242,015 A | | 9/1993 | Saperstein et al. | 165/163 |
| 6,098,704 A | | 8/2000 | Tsuchiya et al. | 165/154 |
| 6,155,075 A | | 12/2000 | Hanson et al. | 62/512 |

* cited by examiner

*Primary Examiner*—Chen Wen Jiang
(74) *Attorney, Agent, or Firm*—Baker & Daniels

(57) ABSTRACT

A heat exchanger including a plurality of thermally-conductive, fluid-conveyance tubes, and at least one header from which each of the plurality of fluid-conveyance tubes extends. The header includes an elongate outer tube and an elongate inner tube disposed eccentrically within the outer tube, with a fluid conduit being defined between the inner tube and the outer tube. The plurality of fluid-conveyance tubes are in fluid communication with the conduit.

31 Claims, 4 Drawing Sheets

HEAT EXCHANGER HAVING HEADER

FIELD OF THE INVENTION

The present invention relates to refrigeration systems, specifically to heat exchangers, which may be used as condensers or evaporators, in the refrigeration systems.

DESCRIPTION OF THE RELATED ART

Previous heat exchangers usually include headers which are used to introduce refrigerant to or receive refrigerant from the tubes of the heat exchanger. A problem with previous headers was that the refrigerant, oil, or other coolant was not distributed in an optimal fashion. The uneven distribution of the refrigerant resulted in poor performance of the heat exchanger and its refrigeration system.

An additional problem with some previous heat exchangers was the walls of the headers were too thin for the size of their passage, and the header could easily be damaged resulting in a need for replacing the heat exchanger. The use of thin-walled tubes is especially noticeable in previous heat exchangers having flattened headers. In heat exchangers utilizing flattened headers, the headers could be easily dented and the passageways therethrough become blocked resulting in a need to replace the heat exchanger.

A heat exchanger header which provides for more efficient distribution of the refrigerant, and which includes walls having sufficient strength to avoid being damaged would be highly desirable.

SUMMARY OF THE INVENTION

The present invention provides a heat exchanger including a plurality of thermally-conductive, fluid-conveyance tubes, and at least one header from which each of the plurality of fluid-conveyance tubes extends. The header includes an elongate outer tube and an elongate inner tube disposed eccentrically within the outer tube, with a fluid conduit being defined between the inner tube and the outer tube. The plurality of fluid conveyance tubes are in fluid communication with the conduit.

The present invention further provides a heat exchanger including means for conveying fluid in the heat exchanger, and at least one header from which the means for conveying fluid extends. The header includes an elongate outer tube and an elongate inner tube eccentrically disposed within the outer tube, with a fluid path being defined between the outer tube and the inner tube. The means for conveying fluid is in fluid communication with the fluid path.

The present invention further provides a header for a heat exchanger including an elongate outer tube, an elongate inner tube eccentrically disposed in the outer tube, and a fluid conduit being defined between the outer tube and the inner tube.

The present invention further provides a refrigeration system including a hermetic compressor assembly, fluid lines extending from the hermetic compressor assembly, a flow restriction device operatively coupled to the compressor assembly via the fluid lines, and at least one heat exchanger operatively coupled to the compressor assembly and the flow restriction device via the fluid lines. The heat exchanger includes a plurality of thermally-conductive, fluid-conveyance tubes, and at least one header from which each of the plurality of fluid-conveyance tubes extends. The header includes an elongate outer tube and an elongate inner tube disposed eccentrically within the outer tube, with a fluid conduit being defined between the inner tube and the outer tube. Each of the plurality of fluid-conveyance tubes is in fluid communication with the conduit.

BRIEF DESCRIPTION OF THE DRAWINGS

The above mentioned and other features and objects of this invention will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION

Figure 1:
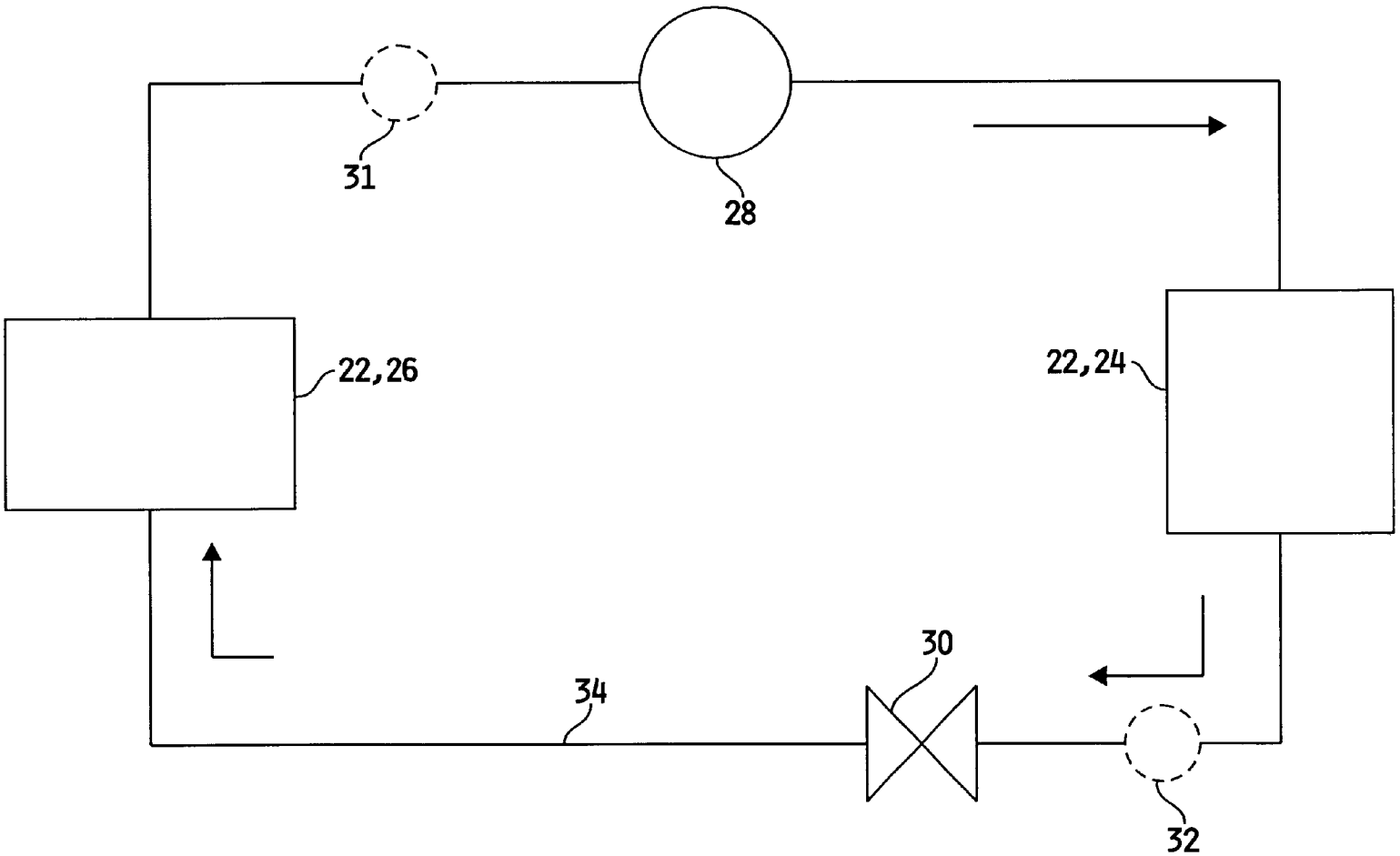
FIG. 1 is a schematic block diagram of a refrigeration system including a heat exchanger having the inventive header therein.

For the purposes of promoting an understanding of the principles of the invention, reference will now be made to the embodiments illustrated in the drawings and specific language will be used to describe the same. It will nevertheless be understood that no limitation of the scope of the invention is thereby intended.

Referring first to FIG. 1, refrigeration system 20 is shown which uses two heat exchangers 22, each heat exchanger 22 having at least one inventive header 23 therein. One heat exchanger is used as an evaporator 26 while the other is used as a condenser 24 and need not be identical. System 20 operates in a known manner with compressor assembly 28 receiving refrigerant, in the form of a low-pressure gas substantially at suction pressure, from evaporator 26 and discharging the refrigerant, as a high-pressure gas substantially at discharge pressure, to condenser 24. Between evaporator 26 and compressor assembly 28 is accumulator 31 (shown in dashed lines), which may collect excess refrigerant, or, downstream of condenser 24 is receiver 32 (shown in dashed lines), which may also collect excess refrigerant.

In condenser 24, the high-pressure refrigerant gas is returned to a high-pressure liquid state through the ambient air absorbing the heat of the refrigerant to cool the refrigerant to its liquid state. After passing through condenser 24, the liquid refrigerant flows through expansion device 30 changing from a high-pressure liquid refrigerant to a low-pressure liquid state, and to evaporator 26. In evaporator 26, the heat in the ambient air is absorbed by the low-pressure liquid refrigerant, thereby causing the refrigerant to enter the low-pressure gas state, which is received by hermetic compressor assembly 28.

Figure 2:
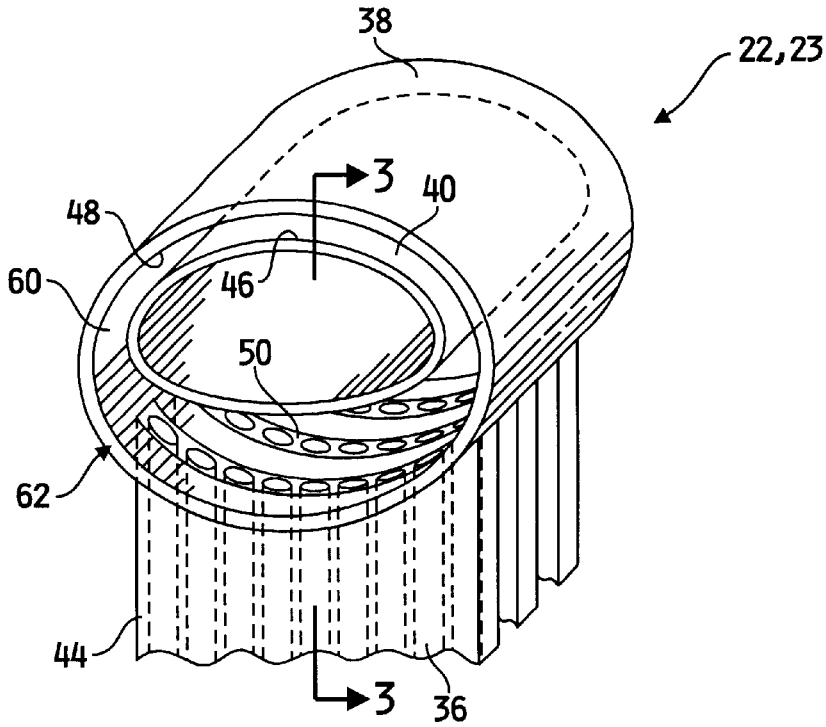
FIG. 2 is a fragmentary cross sectional view of a first embodiment of the inventive header.
Figure 3:
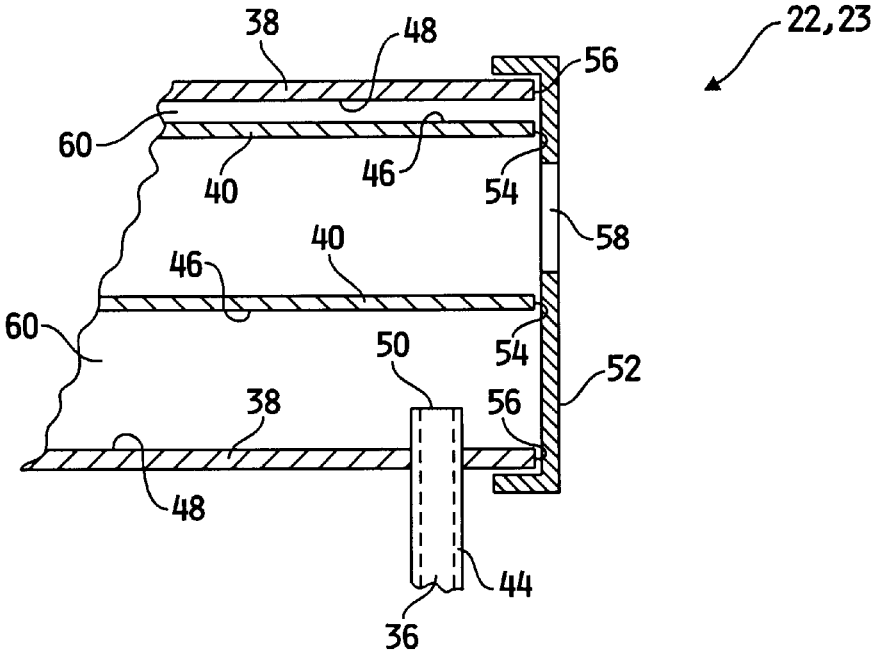
FIG. 3 is a sectional view of the header of FIG. 2, along line 3—3 of FIG. 2, with an axial end cap attached.
Figure 4:
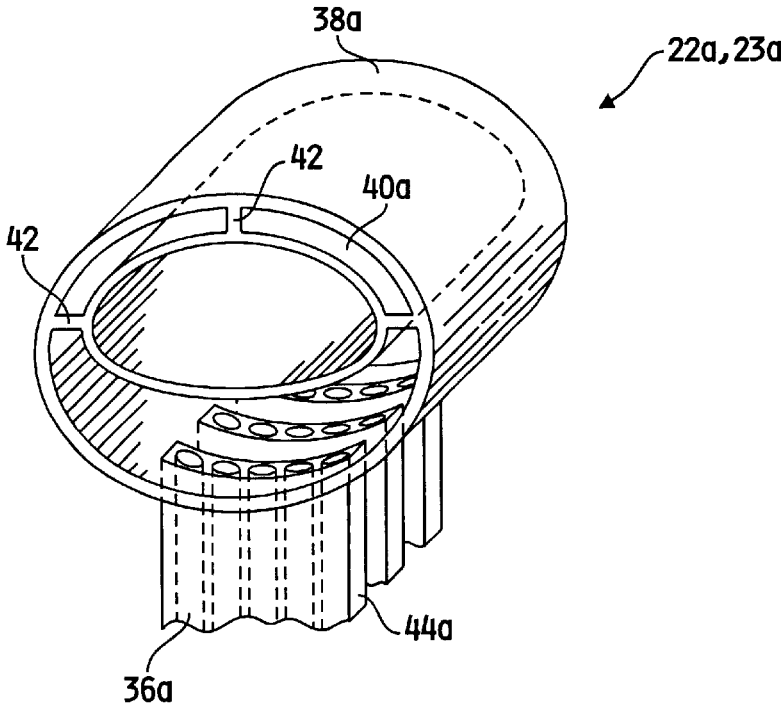
FIG. 4 is a fragmentary cross-sectional view of a second embodiment of the inventive header.
Figure 5:
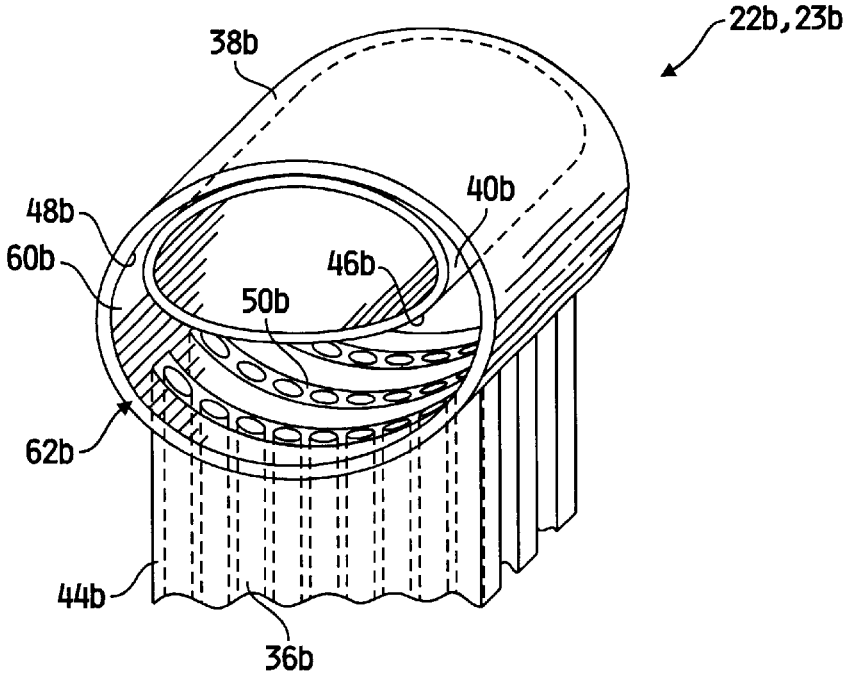
FIG. 5 is a fragmentary cross-sectional view of a third embodiment of the inventive header.

With reference to FIGS. 2 and 3, heat exchanger 22 incorporating inventive heat exchanger header 23 is shown. Header 23 has a tube within a tube construction with outer tube 38 having inner tube 40 eccentrically disposed therein; outer tube 38 and inner tube 40 each have a longitudinal axis. Outer wall 46 of inner tube 40 may contact inner wall 48 of outer tube 38, as shown in FIG. 5. However, as shown in FIGS. 3 and 4, surface contact between inner tube 40 and outer tube 38 is not required. It is to be noted that tubes 38 and 40 are constructed from a relatively strong and thermally conductive material such as aluminum or an alloy thereof to provide sufficient strength in the walls of tubes 38 and 40. Although both outer tube 38 and inner tube 40 are shown as having an elliptical cross-section, the structure of heat exchanger header 23 may be such that only one of the tubes 38 and 40 has an elliptical cross-section with the other having a circular cross-section, or as another alternative, both tubes 38 and 40 may have a circular or other closed cross-section.

Between inner tube 40 and outer tube 38 is formed conduit, or open space, 60. A refrigerant may flow through conduit 60 for operation of heat exchanger 22, as described above. Extending into conduit 60 are tubes 44 having passages 36 which allow the flow of refrigerant into and from the rest of heat exchanger 22. Tubes 44 have aligned ends 50, which may be cut straight across or be cut to conform with the curvature of inner wall 48 of outer tube 38 or outer wall 46 of inner tube 40. It is to be noted that tubes 44 are also constructed from a thermally conductive material, such as aluminum or an alloy thereof.

With reference specifically to FIG. 3, outer tube 38 and inner tube 40 have aligned ends 56 and 54, respectively, which abut axial end caps 52, one of which is located at either end 62 of heat exchanger header 23. End cap 52 provides a sealed end for the heat exchanger header 23 to prevent leakage of any refrigerant from the end of header 23, the seal being provided by welding ends 56 and 54 of tubes 38 and 40 to end cap 52 or by other similar attachment and sealing methods. Heat exchanger 22 is normally oriented such that header 23 is vertically oriented, and end cap 52 may include an aperture 58 which allows entry and exit of ambient air into and from inner tube 40 to provide more efficient heat exchange in header 23 by providing a natural convection air channel therethrough. This increases the effective heat exchange area of the inventive heat exchanger vis-a-vis previous heat exchangers.

Referring to FIGS. 4 and 5, a view of a second and a third embodiment of heat exchanger 22, labeled as heat exchangers 22*a* and 22*b*, respectively, having headers 23*a* and 23*b* are shown. Both heat exchanger headers 23*a* and 23*b* have a tube in a tube construction with outer tubes 38*a* and 38*b* respectively having inner tubes 40*a* and 40*b* disposed therein. As shown in FIG. 4, tubes 38*a* and 40*a* are connected together via walls 42 to ensure that tubes 38*a* and 40*a* do not move relative to one another; walls 42 may extend the length of tubes 38*a* and 40*a*, and tubes 38*a* and 40*a* and walls 42 may be co-extruded. Alternatively, walls 42 may be longitudinally short walls around which fluid would flow. In the third embodiment, shown in FIG. 5, tubes 38*b* and 40*b* have surfaces 46*b* and 48*b* in contact. Heat exchangers 22*a* and 22*b* also respectively include tubes 44*a* and 44*b*, which have passages 36*a* and 36*b* therein, entering conduit 60 defined by outer tubes 38*a* and 38*b* and inner tubes 40*a* and 40*b*.

Figure 6:
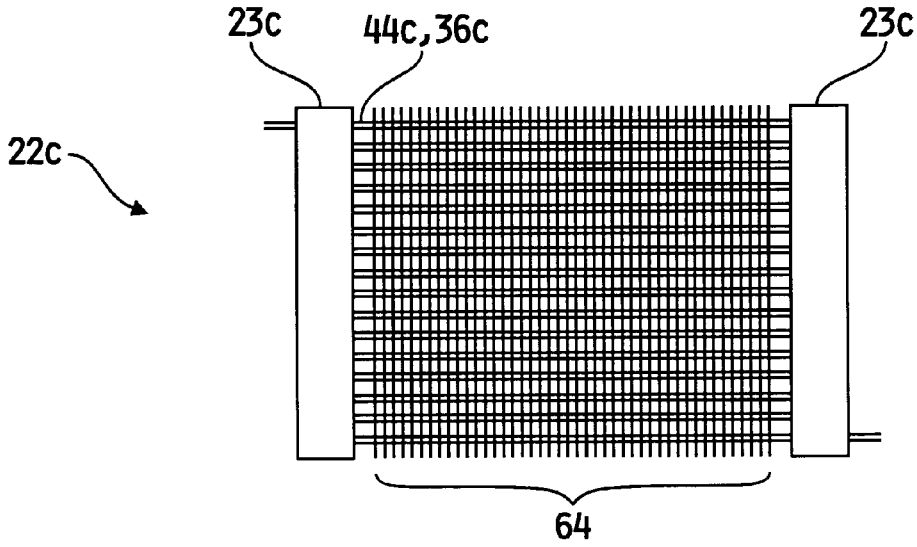
FIG. 6 is a view of an embodiment of a heat exchanger incorporating two inventive headers therein.
Figure 7:
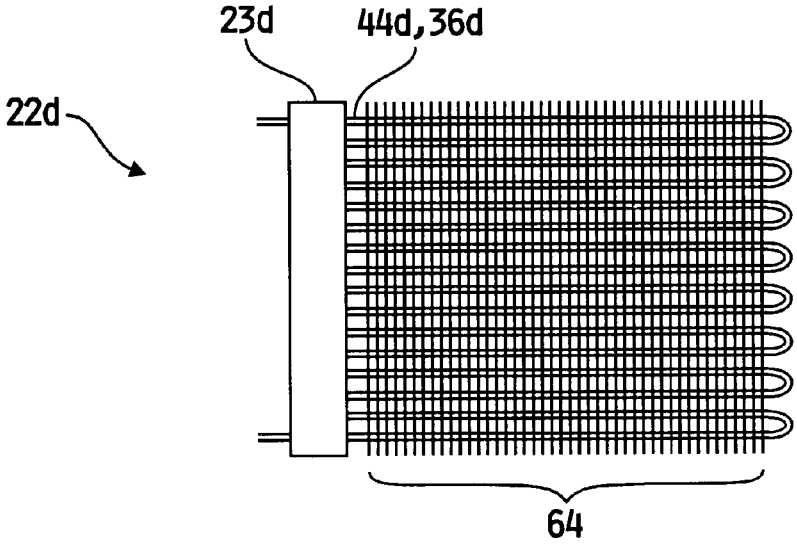
FIG. 7 is a view of an alternative embodiment of a heat exchanger incorporating an inventive header therein.

Referring to FIGS. 6 and 7, two embodiments of heat exchanger 22 are shown and are labeled as heat exchangers 22*c* and 22*d*. Each heat exchanger 22*c* and 22*d* has a plurality of fins 64 press-fitted around tubes 44*c* and 44*d*. Fins 64 may be placed along the length of heat exchangers 22*c* and 22*d*, as shown in FIGS. 6 and 7, or only a portion thereof. Further shown in FIG. 7 is the hairpin structure of tubes 44*d*.

In operation, header 23 is supplied with refrigerant that flows throughout heat exchanger 22. By having the refrigerant flow in conduit 60 between outer tube 38 and inner tube 40, the refrigerant is evenly distributed.

While this invention has been described as having exemplary structures, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heat exchanger comprising:

a plurality of thermally-conductive, fluid-conveyance tubes; and at least one header from which each of said plurality of fluid-conveyance tubes extends, said header comprising an elongate outer tube and an elongate inner tube, said inner tube disposed eccentrically within said outer tube, a fluid conduit being defined between said inner tube and said outer tube, said plurality of fluid-conveyance tubes in fluid communication with said conduit.

2. The heat exchanger of claim 1, wherein said outer tube and said inner tube are substantially thermally-conductive, said inner tube having an outer wall, said outer tube having an inner wall, said inner and outer walls being in contact with each other.

3. The heat exchanger of claim 1, wherein at least one of said outer tube and said inner tube has a substantially elliptical cross-section.

4. The heat exchanger of claim 1, wherein said inner tube has an end, and further comprising a cap sealably attached to said inner tube end and to said outer tube.

5. The heat exchanger of claim 4, wherein said cap is provided with an aperture aligned with the interior of said inner tube, whereby the interior of said inner tube is open.

6. The heat exchanger of claim 4, wherein said inner tube and said outer tube each have a first and a second end, a first said cap is sealably attached to said inner tube first end and to said outer tube first end, and a second cap is sealably attached to said inner tube second end and to said outer tube second end.

7. The heat exchanger of claim 6, wherein said first and second caps are each provided with an aperture aligned with the interior of said inner tube, whereby the interior of said inner tube is open and fluid flow may be established therethrough.

8. The heat exchanger of claim 1, wherein said fluid-conveyance tubes each comprise a plurality of passages therethrough, each of said passages being in fluid communication with said conduit.

9. The heat exchanger of claim 1, wherein said outer tube has a longitudinal axis and said fluid-conveyance tubes define a plane, said plane parallel to said outer tube longitudinal axis.

10. The heat exchanger of claim 1, further comprising a plurality of thermally-conductive fins, said fluid-conveyance tubes operatively engaged with said fins.

11. The heat exchanger of claim 1, wherein said header is a first header and further comprising a second said header, said fluid-conveyance tubes extending between said first and second headers, said fluid-conveyance tubes in fluid communication with the said conduit of each said first and second header.

12. The heat exchanger of claim 11, wherein said first and second headers are substantially parallel.

13. The heat exchanger of claim 11, further comprising a plurality of thermally-conductive fins, said fins in contact with said plurality of fluid-conveyance tubes and disposed between said first and second headers.

14. The heat exchanger of claim 1, wherein said fluid-conveyance tubes are hairpin tubes each having opposite first and second ends in fluid communication with said header conduit.

15. A heat exchanger comprising:

means for conveying fluid in said heat exchanger;

at least one header from which said means for conveying fluid extends, said header including an elongate outer tube and an elongate inner tube, said inner tube being eccentrically disposed within said outer tube, a fluid path being defined between said outer tube and said inner tube, said means for conveying fluid being in fluid communication with said fluid path.

16. The heat exchanger of claim 15, wherein said means for conveying and said outer and said inner tubes are thermally-conductive, said inner tube having an outer wall and said outer tube having an inner wall, said outer wall and said inner wall being in contact with each other.

17. The heat exchanger of claim 15, wherein at least one of said outer tube and said inner tube has an elliptical cross-section.

18. The heat exchanger of claim 15, wherein said inner tube has an end, and further comprising a cap sealably attached to said inner tube end and to said outer tube.

19. The heat exchanger of claim 18, wherein said inner tube and said outer tube each have a first and a second end, a first said cap is sealably attached to said inner tube first end and to said outer tube first end, and a second cap is sealably attached to said inner tube outer second end and to said outer tube second end.

20. The heat exchanger of claim 15, wherein said header is a first header and further comprising a second said header, said means for conveying fluid extending between said first and second headers, said means for conveying fluid in fluid communication with the said conduit of each said first and second header.

21. A header for a heat exchanger comprising:

an elongate outer tube;

an elongate inner tube eccentrically disposed in said outer tube, said inner tube having an open end whereby said inner tube is open to ambient air; and a fluid conduit being defined between said outer tube and said inner tube.

22. The header of claim 21, wherein said outer tube and said inner tube are substantially thermally conductive, said outer tube having an inner wall, said inner tube having an outer wall, said inner wall and said outer wall being in contact with each other.

23. A header for a heat exchanger comprising:

an elongate outer tube;

an elongate inner tube eccentrically disposed in said outer tube wherein at least one of said outer tube and said inner tube has an elliptical cross-section; and a fluid conduit being defined between said outer tube and said inner tube.

24. A header for a heat exchanger comprising:

an elongate outer tube;

an elongate inner tube eccentrically disposed in said outer tube wherein said inner tube has an end, and further comprising a cap sealably attached to said inner tube end and to said outer tube; and a fluid conduit being defined between said outer tube and said inner tube.

25. The header of claim 24, wherein said cap is provided with an aperture aligned with the interior of said inner tube, whereby the interior of said inner tube is open.

26. The header of claim 24, wherein said inner tube and said outer tube each have a first and a second end, a first said cap is sealably attached to said inner tube first end and to said outer tube first end, and a second cap is sealably attached to said inner tube outer second end and to said outer tube second end.

27. The header of claim 26, wherein said first and second caps are each provided with an aperture aligned with the interior of said inner tube, whereby the interior of said inner tube is open and fluid flow may be established therethrough.

28. A refrigeration system comprising:

a hermetic compressor assembly;

fluid lines;

a flow restriction device operatively coupled with said compressor assembly via said fluid lines; and at least one heat exchanger operatively coupled with said compressor assembly and said flow restriction device via said fluid lines including:

a plurality of fluid-conveyance tubes; and at least one header from which each of said plurality of fluid-conveyance tubes extends, said header comprising an elongate outer tube and an elongate inner tube, said inner tube disposed eccentrically within said outer tube, a fluid conduit being defined between said inner tube and said outer tube, each of said plurality of fluid-conveyance tubes in fluid communication with said conduit.

29. The refrigeration system of claim 28, wherein said outer tube, said inner tube, and said fluid conveyance tubes are substantially thermally-conductive.

30. The refrigeration system of claim 28, wherein said inner tube has an end, and further comprising a cap sealably attached to said inner tube end and to said outer tube.

31. The refrigeration system of claim 30, wherein said inner tube and said outer tube each have a first and a second end, a first said cap is sealably attached to said inner tube first end and to said outer tube first end, and a second cap is sealably attached to said inner tube second end and to said outer tube second end.

* * * * *